United States Patent [19]

LeBus

[11] Patent Number: 4,504,063

[45] Date of Patent: Mar. 12, 1985

[54] HUNTING BROADHEAD ARROW

[76] Inventor: Charles F. LeBus, P.O. Box 2352, Longview, Tex. 75606

[21] Appl. No.: 623,339

[22] Filed: Jun. 22, 1984

[51] Int. Cl.[3] ..... F41B 5/02

[52] U.S. Cl. ..... 273/422

[58] Field of Search ..... 273/421, 419, 422, 420; 43/6; 30/158

[56] References Cited

U.S. PATENT DOCUMENTS

| | | | |
|---|---|---|---|
| 2,993,697 | 7/1961 | Urban | 273/421 |
| 3,578,328 | 5/1971 | Rickey | 273/421 |
| 4,099,720 | 7/1978 | Zeren | 273/422 |
| 4,452,460 | 6/1984 | Adams | 273/422 |

*Primary Examiner*—Paul E. Shapiro

*Attorney, Agent, or Firm*—Head, Johnson & Stevenson

[57] ABSTRACT

A hunting broadhead arrow comprising a hollow body or ferrule having a plurality of circumferentially spaced slots extending through the sidewall thereof for receiving a flat substantially triangular shaped blade member in each of the slots. The shank of the point member of the arrowhead extends slidably into the interior of the body and carries a plunger member in the inner end thereof. Each blade is retained in a normal contracted or retracted position with respect to the body by suitable snap ring members, and each blade is provided with a recess on the inner edge thereof for engagement with the outer periphery of the plunger member in the retracted position of the blades. Upon impact of the arrowhead, the point member is moved in a direction toward the body for moving the plunger member rearwardly within the body whereby the trailing ends of the blades are moved radially outwardly to an extending position for the blades, thus increasing the cutting diameter of the blade upon impact to increase the efficiency of the arrowhead.

7 Claims, 8 Drawing Figures

HUNTING BROADHEAD ARROW

BACKGROUND OF THE INVENTION

1. Field of the Invention

This invention relates to improvements in arrowheads and more particularly, but not by way of limitation, to a hunting broadhead arrow.

2. Description of the Prior Art

The use of a bow and arrow in lieu of a rifle, shotgun, or the like, in the hunting of game has become increasingly popular in recent years. Many of the game hunters practising bow and arrow hunting have found the use of a broadhead-type arrow achieves more efficient results, particularly in the hunting of relatively large game. The usual presently available broadhead-type arrow has certain disadvantages in that the speed, distance accuracy of the flight of the arrow shaft through the air is frequently adversely affected by the structural configuration of the arrowhead. In addition, there are certain legal requirements setting forth the conditions under which the use and structure of the broadhead-type arrows must comply. Many attempts have been made to solve the problems encountered with the use of the broadhead-type arrow, such as shown in the Chandler U.S. Pat. No. 2,289,284, issued July 7, 1942, and entitled "Interchangeable Arrowhead;" Recker U.S. Pat. No. 2,753,643, issued July 10, 1956, and entitled "Fishing Arrow; Grissinger U.S. Pat. No. 2,937,873, issued May 24, 1960, and entitled "Hunting Head for an Arrow or the Like;" Richter U.S. Pat. No. 2,940,758, issued June 14, 1960, and entitled "Arrowhead;" Yurchich U.S. Pat. No. 3,014,305, issued Dec. 26, 1961, and entitled "Arrowhead for Bow Fishing;" Swails U.S. Pat. No. 3,036,396, issued May 29, 1962, and entitled "Retractable Arrow;" McKinzie U.S. Pat. No. 3,138,383, issued June 23, 1964, and entitled "Dual Purpose Arrow Head;" Lint U.S. Pat. No. 3,168,313, issued Feb. 2, 1965, and entitled "Hunting Arrowhead with Retractable Barbe;" and the Hendricks U.S. Pat. No. 3,600,835, issued Aug. 24, 1971, and entitled "Spear Head with Swingable Barb." In addition, a broadhead-type arrow is sold under the trademark "Viper" by Tink's Safariland Hunting Corporation, in Mclean, Va.

The McKinzie U.S. Pat. No. 3,138,383 relates to a dual purpose arrowhead wherein the blades may be retracted when the arrow is to be used in practice and may be extended when the arrow is to be used in actual hunting operations. This structure, however, does not overcome the problems inherent with the usual broadhead-type arrow as hereinbefore set forth.

SUMMARY OF THE INVENTION

The present invention relates to a novel broadhead-type arrow which has been particularly designed and constructed for overcoming the foregoing disadvantages. The novel arrowhead is designed for producing a down, low profile position when the arrowhead is in flight, thus providing greater or better arrow flight with increased accuracy. Upon impact, the blades of the arrowhead are extended whereby the cutting diameter of the arrowhead is increased. This increased cutting diameter has been found to increase the tissue damage for a quicker harvest of the game. The arrowhead comprises a central furrule or body having a plurality of blades circumferentially spaced around the outer periphery thereof. Each blade extends through a longitudinal slot provided in the furrule and a plunger means is reciprocally disposed within the interior of the furrule for engagement with the inner edge of the blades. Each blade is provided with a notch or recess portion normally engaged with the plunger means whereby the blade maintains a normal retracted position during flight of the arrow. Upon impact of the arrow, the plunger means is moved rearwardly within the body or furrule for expanding the blades radially outwardly with respect thereto, thus increasing the cutting diameter of the arrow as it penetrates the game impinged by the arrow. The normal retracted position of the blades during flight of the arrow increases the efficiency and accuracy of the arrow, and the automatic extension of the blades upon impact provides increased efficiency for the bow and arrow hunter. The novel hunting broadhead arrow is simple and efficient in operation and economical and durable in construction.

DETAILED DESCRIPTION OF THE PREFERRED EMBODIMENT

Figure 1:
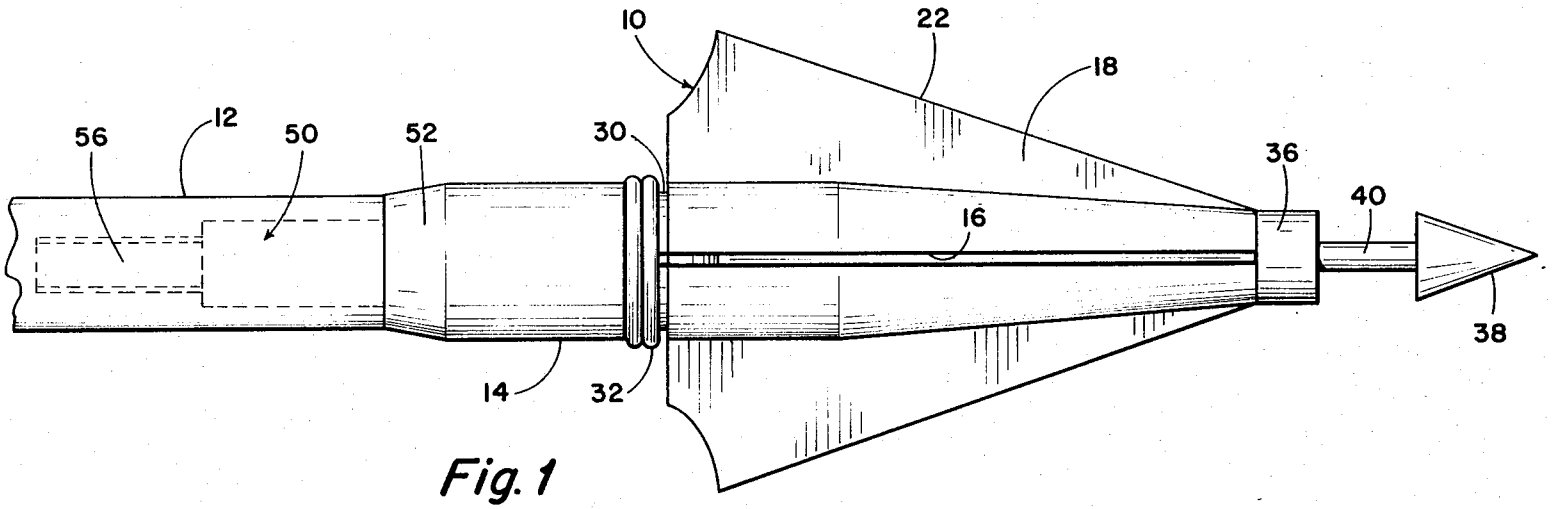
FIG. 1 is a side elevational view of a hunting broadhead arrow embodying the invention, and illustrated in the normal in-flight orientation and secured to an arrow shaft.

Referring to the drawings in detail, reference character 10 generally indicates a hunting broadhead arrow adapted to be secured to one end of an arrow shaft 12 in a manner as will be hereinafter set forth. The arrow head 10 comprises a ferrule or hollow body 14 having a plurality of circumferentially spaced longitudinally extending slots 16 provided on the outer periphery thereof and extending through the sidewall thereof. A blade member 18 of substantially triangular configuration has the inner edge 20 thereof disposed in each of the slots 16 and open to the interior of the ferrule 14 whereby the blade members extend radially outwardly from the outer periphery of the ferrule 14.

Figure 3:
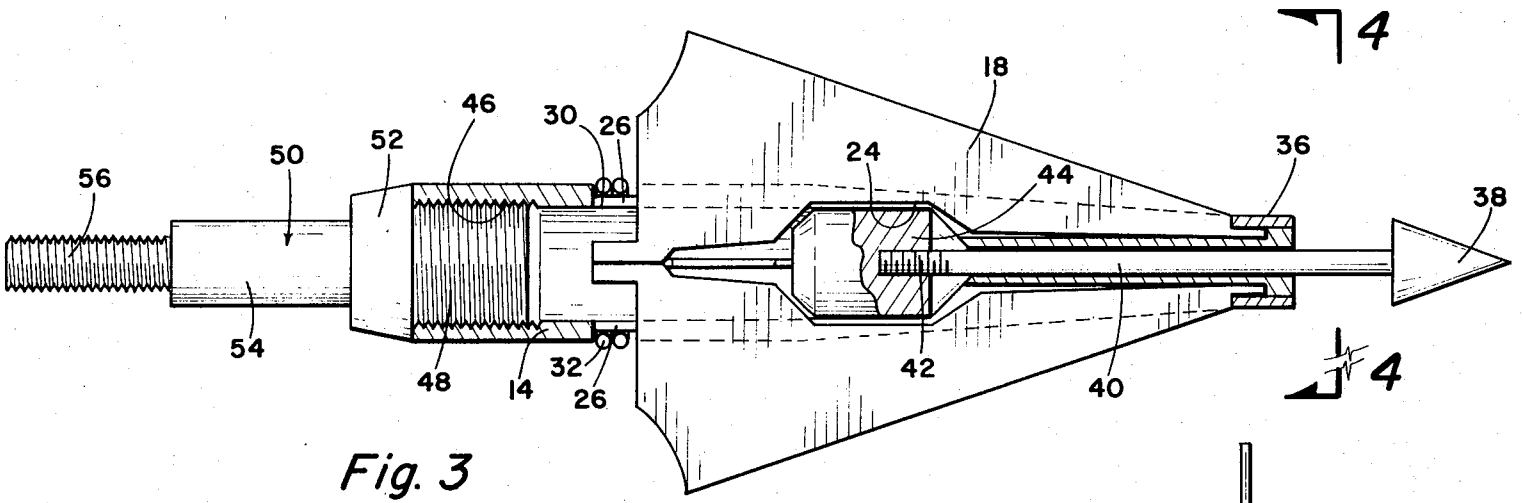
FIG. 3 is a sectional elevational view of a hunting broadhead arrow embodying the invention, and illustrates the arrow in the normal in-flight retracted position of the blades.
Figure 4:
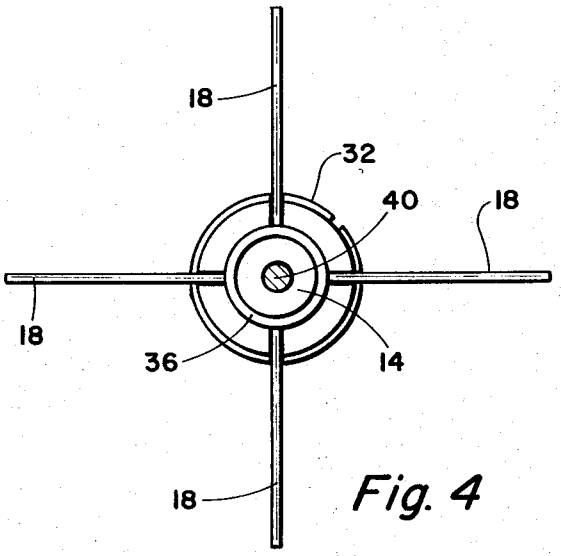
FIG. 4 is a view taken on line 4—4 of FIG. 3.
Figure 8:
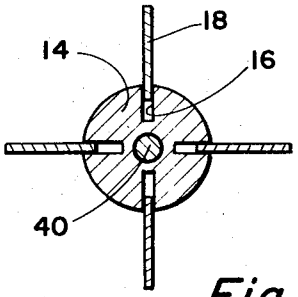
FIG. 8 is a view taken on line 8—8 of FIG. 5.

The blade members 18 are of a substantially flat planar construction, and the outer sharp or cutting edge 22 thereof is disposed at an angle with respect to the inner edge 20 and longitudinal axis of the ferrule 14 when secured thereto. A substantially centrally disposed recess 24 is provided along the inner edge 20 of the blade 18 for a purpose as will be hereinafter set forth. In addition, a first axially outwardly extending finger 26 is provided at one end of each blade 18 and a second axially outwardly finger 28 is provided at the opposite end of the blade 18. The fingers 26 and 28 are disposed in the respective slot 16 as particularly shown in FIGS. 3 and 5.

An annular recess 30 is provided around the outer periphery of the ferrule 14 in the proximity of the first finger 26 and for receiving suitable snap ring means 32 therein for securing the finger 26 in the respective slot 16. In addition, a reduced diameter neck portion 34 is provided on the outer periphery of the ferrule 14 in spaced relation with respect to the recess 30 and in substantial alignment with the second finger 28 for receiving a sleeve member 36 thereon to retain the finger 28 in the respective slot 16. In this manner, each blade 18 is removably secured in its respective slot 16. It is to be understood that substantially any desired number of the blades 18 may be circumferentially spaced around the outer periphery of the ferrule 14, although three or four of the blades is preferred.

Figure 2:
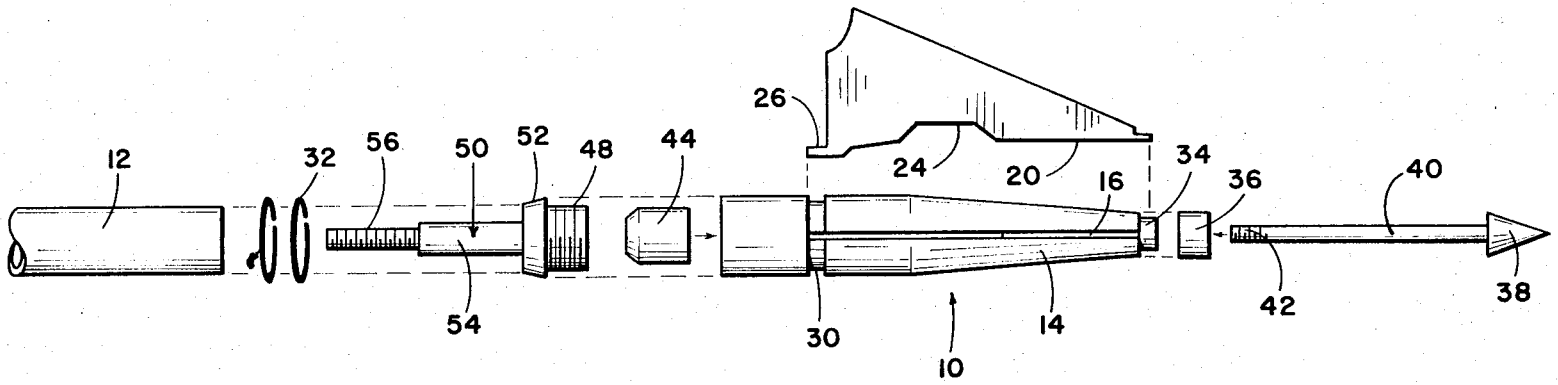
FIG. 2 is an exploded side elevational view of the arrow shown in FIG. 2.

A point means 38, preferably constructed from a carbon steel material, but not limited thereto, may be secured to or may be integral with an axially outwardly extending shaft means 40. The shaft means 40 extends slidably into and longitudinally within the interior of the ferrule 14 and may be threaded at the outer end thereof as shown at 42 in FIG. 2 for receiving a plunger means 44 thereon. The outer periphery of the plunger 44 is of a configuration complementary to or corresponding with the configuration of the recess 24 of the blades 28 and in the normal position or orientation of the arrowhead 10, the plunger 44 is disposed in engagement with the recesses 24 of the blades 18 disposed in the slots 16 as particularly shown in FIG. 3.

The inner periphery of the ferrule 14 may be provided with a threaded portion 46 disposed outboard of the recess 30 (FIG. 3) for receiving the threaded stud member 48 of an insert means 50 therein. An annular stop member 2 may be provided on the insert means 50 conterminous with the threaded stud 48 for limiting the depth of threaded insertion of the stud 48 within the threaded portion 46 of the ferrule 14. A reduced diameter stem or shank member 54 extends axially outwardly from the stop means 52 in a direction away from the stud 48 and may be threaded as shown at 56 for threaded engagement with the arrow shaft 12 in order to secure the arrowhead 10 to the shaft 12, as is well known.

In use, the arrowhead 10 is normally arranged whereby the plunger means 44 is in engagement with the recesses 24 of the blades 18 secured around the outer periphery of the ferrule 14. In this position of the plunger means, the point means 38 is disposed in slightly spaced relation with respect to the leading end of the ferrule 14 and the blades 18 are disposed in a retracted position as particularly shown in FIGS. 1 and 3. The yieldable nature of the snap rings 30 hond the fingers 26 in a radially inwardly position in the respective slots 16 for retaining the blades 18 in this normally retracted position. When the arrowhead 10 and shaft 12 are utilized in the normal manner, the blades 18 remain in the retracted position during the flight of the arrow, thus providing a down position for the blades to produce a low profile position for better arrow flight and greater accuracy.

Figure 5:
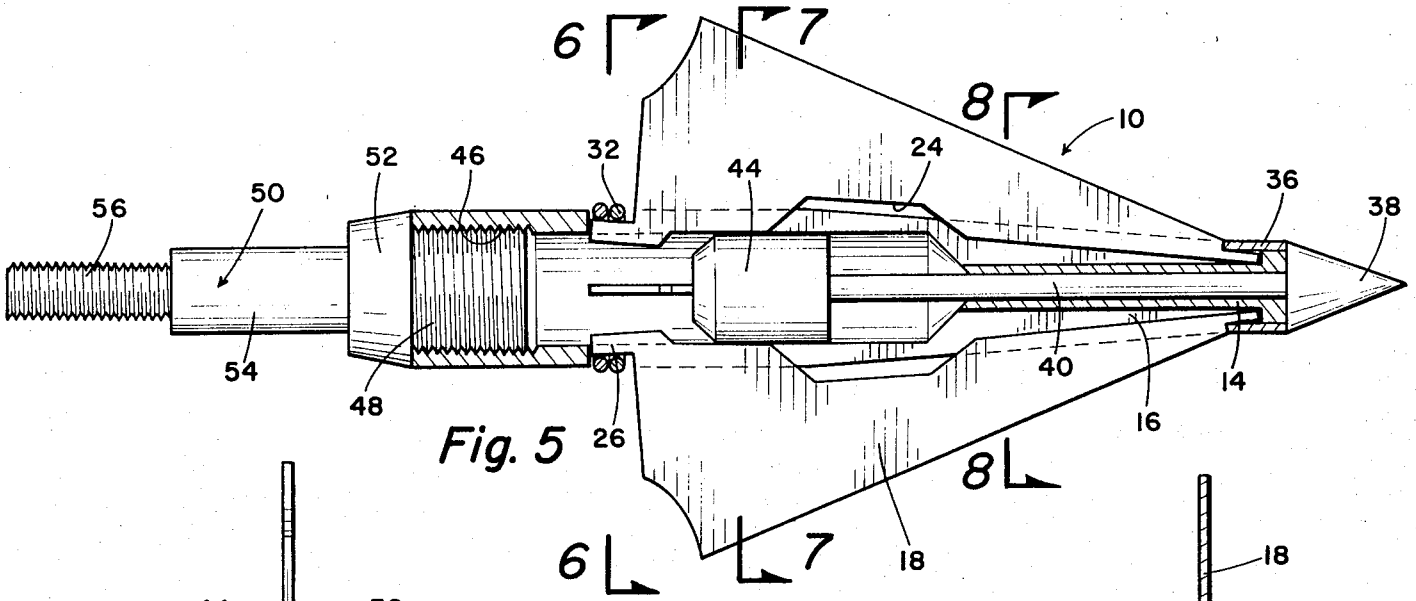
FIG. 5 is a sectional elevational view of a hunting broadhead arrow embodying the invention, and illustrates the extended impact position of the blades.
Figure 7:
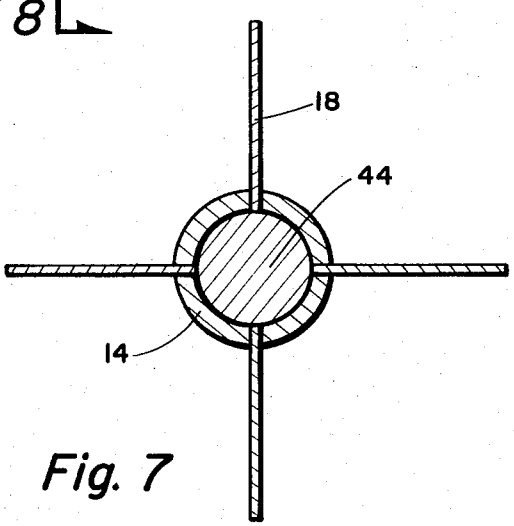
FIG. 7 is a view taken on line 7—7 of FIG. 5.
Figure 6:
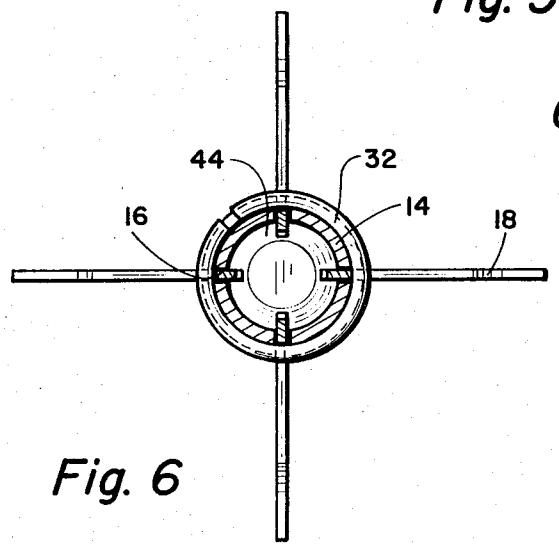
FIG. 6 is a view taken on line 6—6 of FIG. 5.

Upon impact of the arrowhead 10 with game (not shown) or the like, the point means 38 is forced in a direction toward the ferrule 14. This moves the plunger means rearwardly within the interior of the ferrule 14 and out of engagement with the recesses 24. This action forces the trailing ends of the blades 18 radially outwardly against the force of the snap rings 32, as shown in FIG. 5 thus extending the blades radially outwardly for increasing the cutting diameter of the arrowhead 10. This increased cutting diameter has been found to increase tissue damage of the game struck by the arrowhead, thus producing a quicker harvest of the game.

From the foregoing it will be apparent that the present invention provides a novel hunting broadhead arrow having a plurality of circumferentially spaced blades secured around the outer periphery of a ferrule and retained in a normally retraced position with respect to the ferrule. Plunger means secured to or carried by the the arrowhead point means extends slidably within the interior of the ferrule and is in a normal position of engagement with recess means of the retracted blades during non-use of the arrowhead, or during flight of the arrowhead. Upon impact, the point means is moved in a direction toward the ferrule means for moving the plunger means rearwardly within the ferrule for expanding the blades radially outwardly to an extended orientation therefor. The retracted position of the blades in flight improves the accuracy of the flight of the arrow, and the extended position of the blades upon impact improves the end result of the hunting broadhead arrow.

Whereas the present invention has been described in particular relation to the drawings attached hereto, it should be understood that other and further modifications, apart from those shown or suggested herein may be made within the spirit and scope of this invention.

What is claimed is:

1. A hunting broad arrow comprising hollow body means, a plurality of circumferentially spaced longitudinally extending slots provided in the body means and extending through the sidewall thereof, normally retracted independent blade means disposed in each slot and having one edge open to the interior of the hollow body means, shaft means slidably disposed in the hollow body and having one end extending axially outwardly therefrom, point means provided on the outwardly extending end of the shaft means, plunger means provided on the opposite end of the shaft means and slidably disposed within the interior of the hollow body means, retaining means disposed on the hollow body for retaining the blade means in the normal retracted position thereof during flight of the arrow, the plunger means being responsive to movement of the point means in one direction for overcoming the force of the yieldable means for moving the blade means radially outwardly to provide an increased cutting diameter for the arrow upon impact thereof with an object.

2. A hunting broadhead arrow as set forth in claim 1 wherein the blade means comprises a plurality of flat substantially triangular shaped blade members each having an inner edge open to the interior of the hollow body and an outer cutting edge extending angularly divergent with respect to the inner edge, and finger means provided on each blade member for cooperating with the retaining means for securing the blades on the hollow body means.

3. A hunting broadhead arrow as set forth in claim 2 wherein the retaining means comprises yieldable means disposed around the outer periphery of the hollow body means and engageable with the finger means.

4. A hunting broadhead arrow as set forth in claim 3 wherein the retaining means includes sleeve means disposed around the outer periphery of the hollow body means in spaced relation with respect to the yieldable means and engagable with the finger means.

5. A hunting broadhead arrow as set forth in claim 4 wherein the finger means comprises first axially extending finger means disposed in the respective slot and engagable by the yieldable means, and second axially extending finger means extending in a direction away from the first finger means and engagable by the sleeve means.

6. A hunting broadhead arrow as set forth in claim 2 and including recess means provided on the inner edge of each blade member for engagement by the plunger means in the retracted position of the blade means.

7. A hunting broadhead arrow as set forth in claim 1 and including insert means for securing the arrow to an arrow shaft.

* * * * *